United States Patent [19]

Fuller et al.

[11] Patent Number: 4,872,580

[45] Date of Patent: Oct. 10, 1989

[54] CARPET SAMPLE HOLDER

[76] Inventors: Robert T. Fuller, 1351 Empire St., Anaheim, Calif. 92804; Robert J. Sanders, 2200 E. Oshkosh Cir., Anaheim, Calif. 92806

[21] Appl. No.: 304,916

[22] Filed: Feb. 1, 1989

Related U.S. Application Data

[63] Continuation of Ser. No. 74,583, Jul. 17, 1987, abandoned.

[51] Int. Cl.[4] ..... A47F 7/16

[52] U.S. Cl. ..... 211/45; 211/55; 211/11

[58] Field of Search ..... 211/45, 11, 184, 101, 211/133, 47, 55, 181, 128; 108/60, 61

[56] References Cited

U.S. PATENT DOCUMENTS

| | | | |
|---|---|---|---|
| 1,415,110 | 5/1922 | Pearl | 211/11 |
| 1,664,650 | 4/1928 | Van Korloar | 211/11 |
| 3,244,288 | 4/1966 | Schreter | 211/55 X |
| 4,023,682 | 5/1977 | Niece | 211/184 |
| 4,682,697 | 7/1987 | Cohen | 211/45 |

OTHER PUBLICATIONS

Assembly Instructions for NU-VUE Displays NVP18 and NV18.

*Primary Examiner*—Sarah A. Lechok
*Attorney, Agent, or Firm*—Donald D. Mon

[57] ABSTRACT

A modular rack for holding and displaying carpet samples. The rack has sloping spaced-apart baffles that form slots to receive the samples. The underside of the rack has attachment means to attach to a grip on a stand. Preferably the grid includes parallel rods to which hook-like attachment means are engaged.

2 Claims, 1 Drawing Sheet

CARPET SAMPLE HOLDER

This is a continuation of co-pending application Ser. No. 074,583 filed on July 17, 1987 now abandoned.

FIELD OF THE INVENTION

This invention relates to a holder for displaying a plurality of loose, shingled carpet samples.

BACKGROUND OF THE INVENTION

In order to sell carpets, a salesroom must make available to the prospective purchaser at least one large area sample of each carpet style in one color, and a smaller sized sample of the same style in every other color in which it is available. One known technique is to mount all of these to a single board. This deprives the prospective purchaser of the opportunity to handle the samples, or to obtain suitably sized pieces of most of the colors, something that most purchasers prefer to have. This way of displaying samples does have the advantages of requiring minimal floor area, and of being readily manipulated by the salesman. Still it lacks much in the way of enticement.

Another display technique is to provide bound books of relatively large samples, one of each color. This does enable the customer to feel the product and obtain small pieces. Also the samples can be taken out of the book for individual consideration. However, the books are heavy. It is difficult to hold the samples apart to see one in the middle of the stack, and even when this is done, only some of it can be seen, while the salesman sweats to hold the book open. If the book is unbound to release a sample, then maybe the sample is later replaced, and maybe the book is put together again. And maybe not. This results in a poorly disciplined and burdened salesroom.

The above objectionable fatures have not gone unnoticed, nor has there been a lack of efforts to overcome them. Among the most effective efforts are those which display the samples in a shingled pattern on a stand wherein the samples can be hinged apart from one another, and can be removed from the display without undue effort. Some such displays are sometimes called "waterfalls". Others are shingled on racks, and the racks may or may not be pivoted. These represent very substantial improvements in the art, and are receiving considerable acceptance. The customer has good access to each sample and the product is attractively displayed.

Still, as it is with seemingly all improvements, there remain substantial disadvantages that could be overcome if only the person who must pay for it, and who hopes to present the samples to the customer in its best and most attractive condition, would pay for it.

Improvements in this trade therefore must relate to cost of a proposed display device, and to what must be done to the sample to hold it to the display device. If the carpet must have holes punched in it for mounting purposes, the cost goes up, and the attractiveness goes down. If the sample is tightly bound or put in a stack, the nape of the carpet may be crushed and be less attractive. A skillful salesman invariably brushes a sample with his hand to fluff it up and remove undesired patterns. Such efforts are a distraction and are sometimes omitted to the disadvantage of the sales efforts. Also, the more complicated the attachment means, the more expensive they are likely to be. In addition, it seems that the more expensive attachment means tend to mar the carpet. However clumsy all of this may be, carpet sales companies are understandably reluctant to spend more than they have to for display devices. Many to this day continue to rely primarily on sample books, despite their disadvantages.

It is an object of this invention to provide an attractive, inexpensive display device which does not require a deforming physical grip on the sample to hold it in place, and which provides an attractive undistorted shingled display from which the samples can be withdrawn without manipulation other than a straight in-plane pull. The portion of the device which performs the function that previously required expensive parts or parts which could mar the carpet can now be provided with a relatively inexpensive injection molded article.

BRIEF DESCRIPTION OF THE INVENTION

This invention comprises a modular rack releasably attachable to a grid. The grid comprises a pair of parallel support rods. The rack comprises a base, a plurality of parallel, spaced apart support baffles, and attachment means for attaching the base to the grid.

According to a preferred but optional feature of the invention, a stand supports the grid, and has a pair of side rails, one on each side. The modular rack attaches to the grid, and samples can be slidably inserted between the baffles to be supported by them in an upwardly tilted position, and restrained by the rails from sliding out sidewardly.

According to yet another preferred but optional feature of the invention, the attachment means comprises flexible hooks adapted to snap over the rods to hold the rack to the support.

The above and other features of this invention will be fully understood from the following detailed description and the accompanying drawings, in which:

DETAILED DESCRIPTION OF THE INVENTION

Figure 2:
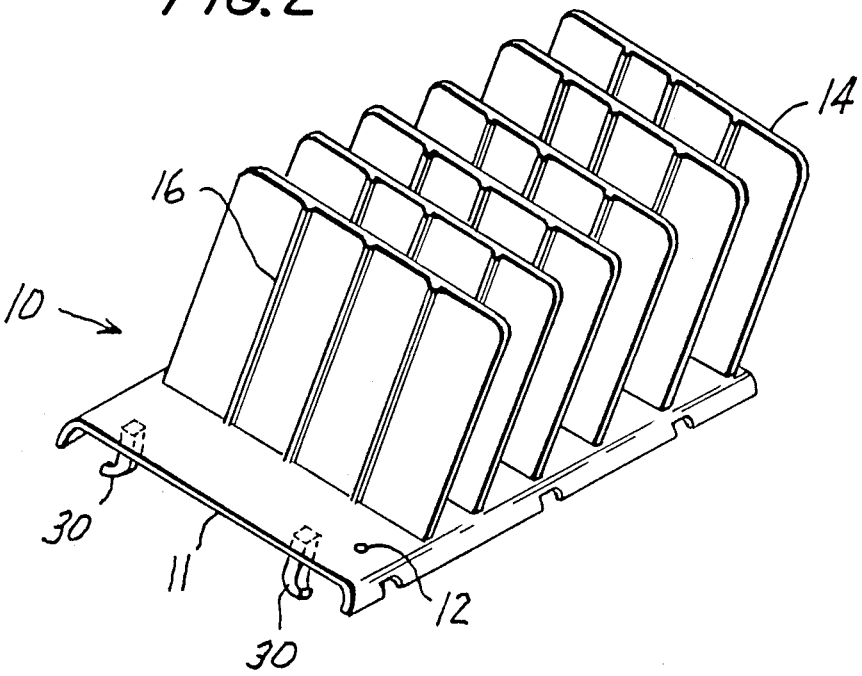
FIG. 2 is a perspective view of the presently preferred embodiment of a modular rack.
Figure 3:
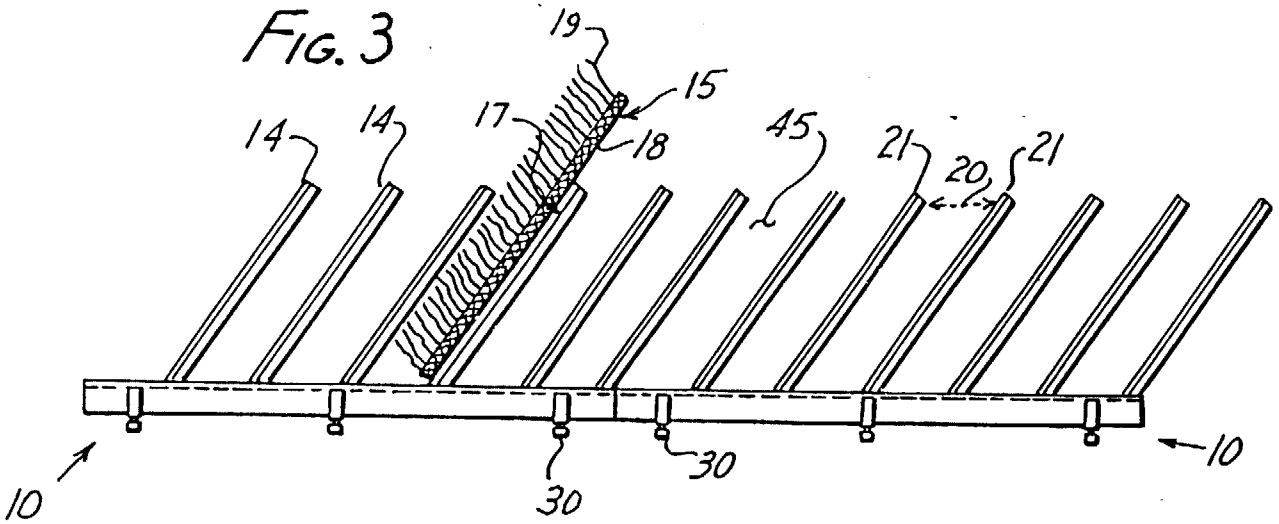
FIG. 3 is a side view of FIG. 2.
Figure 4:
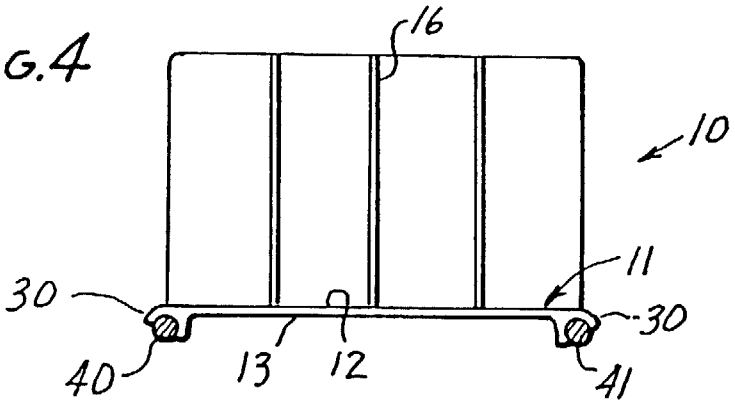
FIG. 4 is an end view of FIG. 3.

A modular rack 10 according to the invention is shown in FIGS. 2, 3 and 4. It includes a base 11 having an upper surface 12 and a lower surface 13. A plurality of blades 14 are parallel to and spaced apart from one another slidingly to receive carpet samples 15 between them.

The rack is preferably formed as a molded plastic product. The blades are then integrally formed with the base. It is, of course, possible to form them separately and then attach them to the base. Stiffener ribs 16 may advantageously be formed on the face 17 of each blade. Preferably this face will abut the backing 18 of the sample rather than its pile 19. Thus, the pile faces a smooth surface that does not indent the carpet sample.

A horizontal spacing 20 between the tips 21 of the blades is provided for holding and display of samples of widely differing thicknesses. The blades are advantageously inclined upwardly from the horizontal by about 55 degrees. The length along the blades from base to tip is advantageously about $3\frac{1}{4}$ inches, and the width is about 5.40 inches.

Integral with, or fastened to the base at its lower surface is a plurality of attachment means 30. Conveniently these will be provided as stiffly flexible hook-like structures molded as part of the base. Best results are attained when there are two sets or pairs of these hooks, for reasons that will become apparent.

A stand 35 comprises legs 36 and side rails 37, 38. The side rails are parallel and laterally spaced apart. A grid 39 comprises a plurality of rods, such as rods 40, 41, that extend parallel to each other in pairs, between the side rails. Conveniently the rods will be circularly sectioned.

Figure 1:
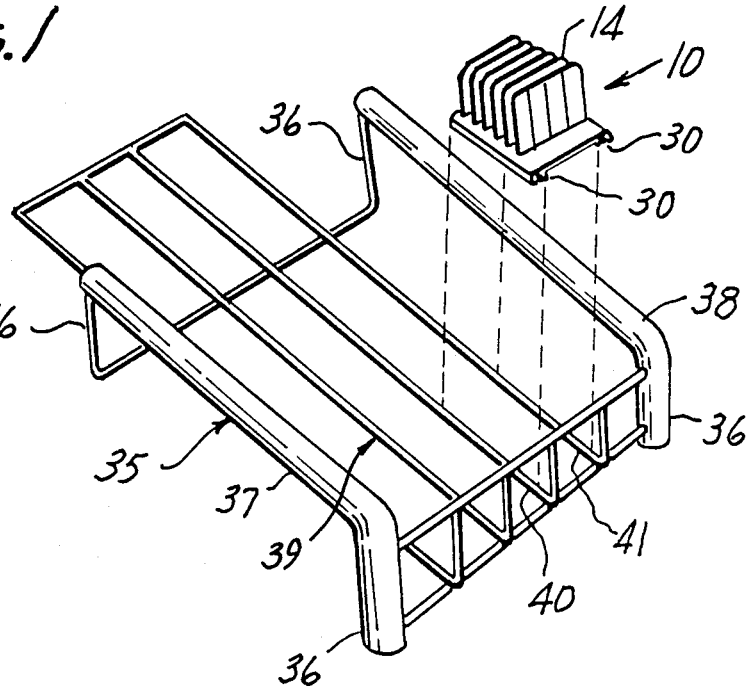
FIG. 1 is a perspective view of the presently-preferred embodiment of a support stand.

This stand is intended to receive the modular racks in any number and arrangement desired. All that is needed is to snap the hooks over the rods as shown in FIGS. 1 and 4, and the device is ready to receive the samples. The racks are as easily removed.

The samples are simply slided into the slots 45 formed between the blades, where their shingled edges are readily viewed. The forward sample is even more visible. The distance the samples project beyond the blades is arbitrary. This distance is foreshortened in FIG. 3 for convenience in illustration.

Thus, this invention provides an inexpensive display device that attractively displays samples in a way that they can be seen, and can easily be removed and replaced. They are not crushed or modified by attachment or mounting structure. The salesman and customer are provided with an attractive and readily affordable construction, in which every sample can easily be removed for close inspection by an in-plane pull on the sample.

This invention is not to be limited by the embodiment shown in the drawings and described in the description, which is given by way of example and not of limitation, but only in accordance with the scope of the appended claims.

We claim:

1. A carpet sample display device comprising:

a stand including a grid which has a pair of parallel rods: and a rack having a base with a generally flat upper surface and a lower surface, said surfaces having a substantial dimension of width, a plurality of parallel, spaced apart blades attached to and extending away from said upper surface at an oblique angle relative thereto, each of said blades having a substantial dimension of width and of length, each pair of adjacent blades forming a clear slot between them which is open at the sides and free ends of said blades, the face of each blade which is intended to bear against the pile of a carpet sample placed in the respective slot being smooth so as not to form a pattern on that carpet sample, and a plurality of hook-like members on and projecting below said lower surface adapted releasably to engage to a respective said rod, there being at least one said hook-like member for each rod of said pair of rods.

2. A carpet sample display device according to claim 1 in which said rack is an integral and continuous structure formed by molding of an organic plastic material.

* * * * *

UNITED STATES PATENT AND TRADEMARK OFFICE

CERTIFICATE OF CORRECTION

PATENT NO. : 4,872,580

DATED : Oct. 10, 1989

INVENTOR(S) : Robert T. Fuller, et al.

It is certified that error appears in the above-identified patent and that said Letters Patent is hereby corrected as shown below:

The sheet of drawings consisting of Figs. 3 and 4 should be added as shown on the attached sheet.

Signed and Sealed this

Twentieth Day of March, 1990

*Attest:*

*Attesting Officer*

JEFFREY M. SAMUELS

*Acting Commissioner of Patents and Trademarks*